US006209476B1

(12) United States Patent
Maurel et al.

(10) Patent No.: US 6,209,476 B1
(45) Date of Patent: Apr. 3, 2001

(54) PNEUMATIC BOAT WITH AN INFLATABLE KEEL

(75) Inventors: Didier Maurel, Fonsegrives; Dominique Zeromski, Villenouvelle, both of (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 09/595,743

(22) Filed: Jun. 16, 2000

(30) Foreign Application Priority Data

Jun. 21, 1999 (FR) ..... 99 07821

(51) Int. Cl.[7] ..... B63B 7/00
(52) U.S. Cl. ..... 114/345; 441/40
(58) Field of Search ..... 114/345; 441/40, 441/131

(56) References Cited

U.S. PATENT DOCUMENTS

| | | | | |
|---|---|---|---|---|
| 2,698,020 | | 12/1954 | Phane . | |
| 5,152,018 | | 10/1992 | Lea . | |
| 5,642,685 | * | 7/1997 | Garnier | 114/345 |
| 5,868,095 | * | 2/1999 | Zeromski et al. | 114/345 |

FOREIGN PATENT DOCUMENTS

| | | | |
|---|---|---|---|
| 3205512 | * | 10/1982 | (DE) . |
| 3603538 | | 2/1986 | (DE) . |
| 0693429 | | 1/1996 | (EP) . |
| 1155376 | | 4/1958 | (FR) . |
| 2230814 | | 12/1974 | (FR) . |
| 2463046 | | 2/1981 | (FR) . |
| 2760717 | | 9/1998 | (FR) . |
| 2765855 | | 1/1999 | (FR) . |
| 2168932 | * | 7/1986 | (GB) . |

* cited by examiner

*Primary Examiner*—Jesus D. Sotelo
(74) *Attorney, Agent, or Firm*—Dean W. Russell; Kirkpatrick Stockton LLP

(57) ABSTRACT

A pneumatic boat comprising a generally U-shaped float open towards the rear and made up of at least one pneumatically inflatable tube, the rear ends of which are braced by a rear board, a rigid floor disposed at least transversely inside the float and a hull with a V-shaped cross section formed by a flexible canvas fixed to the float and to the rear board and held taut by a longitudinal inflatable keel inserted between said floor and said canvas; the inflatable keel is formed by an elongate enclosure delimited by two substantially flat and approximately parallel main walls extending longitudinally and approximately perpendicular to the floor, these walls being braced by a plurality of flexible links; and this enclosure is inflated to a relatively high pressure.

9 Claims, 4 Drawing Sheets

FIG.10.
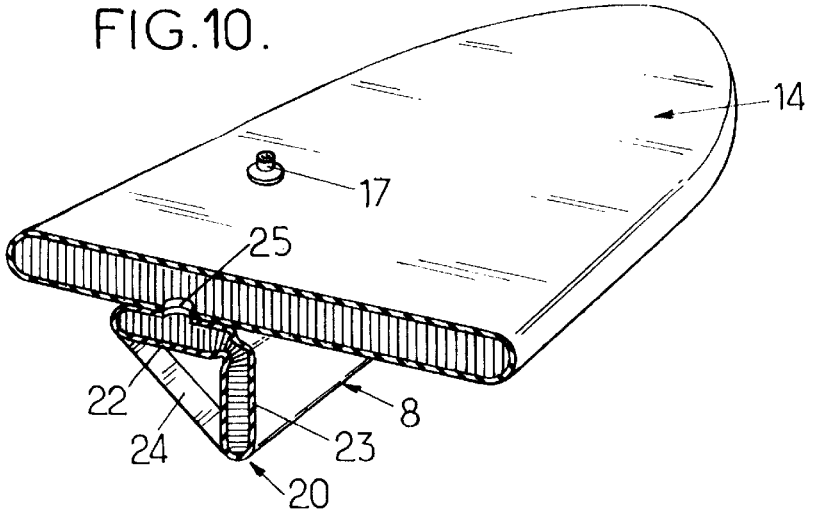
FIG.11.
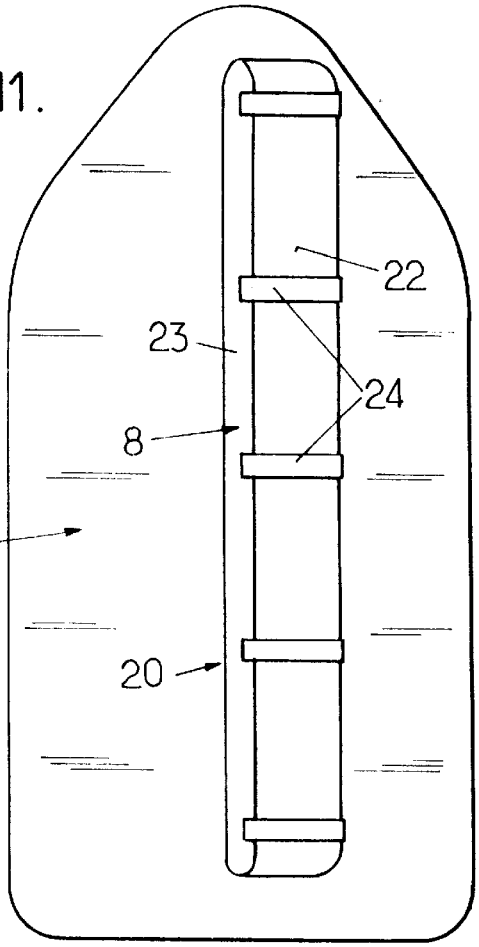
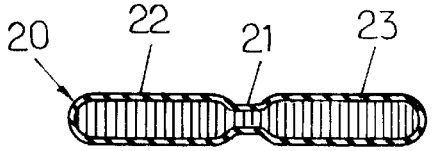
FIG.12A.
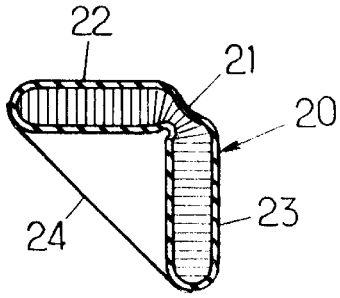
FIG.12B.

PNEUMATIC BOAT WITH AN INFLATABLE KEEL

FIELD OF THE INVENTION

The present invention relates to improvements made to pneumatic boats comprising a generally U-shaped float open towards the rear and formed by at least one pneumatically inflatable tube, the rear ends of which are braced by a rear board, a rigid floor being disposed at least transversely inside the float, and a V-shaped hull made from a flexible canvas fixed to the float and to the rear board and held taut by a longitudinal inflatable keel inserted between said floor and said canvas.

DESCRIPTION OF THE PRIOR ART

So designed pneumatic boats are already known for example from documents FR 1 155 376, FR 2 510 064 and FR 2 734 234.

Using an inflatable keel offers an advantage over solid keels (made from wood for example) because of the light weight and the ease with which the deflated, folded pneumatic boat can be stored and transported.

However, the inflatable keels currently used have an inherent disadvantage in the way they are made. Inflatable keels are made in the form of an inflatable tube with an approximately circular cross section of a changing diameter which imparts a required specific longitudinal shape to the keel (see FIGS. 7 and 7*a* of document FR 1 155 376).

The disadvantages resulting from this design are as follows:

a) a bow height (determined by the front part of the keel) which is necessarily reduced in order to avoid having to use a keel with a tube of too large a diameter which would require a large volume of gas for inflation purposes, and b) a bow which is increasingly less streamlined the larger is the diameter of the tube used for the keel.

In practice, therefore, it is necessary to find a compromise when determining the diameter of the inflatable tube used for the inflatable keel whereby the diameter must be large enough to carry a high enough bow to impart a satisfactory heading hold to the craft but which at the same time must be as small as possible so that the bow remains sufficiently streamlined to fulfil its navigation function satisfactorily when contending with waves and so that the volume of gas needed to inflate it is not excessive.

Finally, there is another disadvantage inherent in the relatively low inflation pressure of the tube forming the keel (this pressure generally being the same as that used for buoyancy tube) which does not make the keel rigid enough, relatively speaking.

It should be pointed out at this point that solid keels, made from wood for example, do not have any of the disadvantages mentioned above in connection with inflatable keels since they can be designed to produce the requisite height and bow streamlining and are intrinsically rigid. On the other hand, they have the particular disadvantage of being heavy and cumbersome: they are generally made in a single piece of an elongate shape which makes storage difficult when the boat is deflated and folded ready for transportation or storage.

SUMMARY OF THE INVENTION

Accordingly, an object of the invention is substantially to propose an original technical solution which will combine the respective advantages of solid and inflatable keels whilst avoiding their respective disadvantages and to do so without incurring excessive additional cost.

With this aim in view, the invention proposes a pneumatic boat as above mentioned in the preamble, which is characterised in that the inflatable keel is made from an elongate enclosure delimited by two approximately parallel main walls extending longitudinally and approximately perpendicular to the floor, these walls being braced by a plurality of flexible links, and in that this enclosure is inflated to a relatively high pressure.

Advantageously, the inflatable enclosure is of a flat, plate-type shape, its thickness being very much smaller than its height and its length.

The bottom edge of the inflatable enclosure can be arranged so that it is curved, and in particular that the height of said enclosure increases very rapidly from the front end so as to define a bow, after which it decreases gradually towards the rear end, and the maximum height of the enclosure in the vicinity of the front end is relatively big so as to impart to the tautened canvas the shape of a streamlined bow with a relatively closed V-shape so that the hull is of a shape which is suitable for handling optimum conditions of navigability.

As a result of the features proposed by the invention, a pneumatic keel is provided which offers the advantages of a conventional inflatable keel (lightness, small volume and low space requirement in the non-inflated state, and is easy to fold up with the rest of the boat) whilst at the same time, because it is inflated to a high pressure, having the advantages of a conventional solid keel, made from wood for example (rigidity, streamlining, height at the front end, optimum bow design).

In some types of pneumatic boats, the floor may be provided as a pneumatic floor in the form of a flat pocket delimited by two approximately parallel main walls braced by a plurality of flexible links, this pocket being inflated to a relatively high pressure, whilst the inflatable enclosure forming the keel is joined longitudinally and axially to the bottom face of said floor so as to form a single piece with a T-shaped cross section.

It would also be conceivable for the hull to be formed, at least in the vicinity of the tip of the V, by at least one flat pocket with a flat V-shaped cross section, inflated to a relatively high pressure, and to join the inflatable enclosure forming the keel longitudinally and axially to the top face of said V-shaped pocket so as to form a single unit.

In either case, it is of advantage if there is a pneumatic communication between the inflatable floor and/or the V-shaped pocket of the hull on the one hand and the inflatable enclosure forming the keel on the other, and if the single unit is fitted with a single valve so that the floor and/or the V-shaped pocket of the hull can be inflated at the same time as the keel.

In one specific embodiment, which is preferred because of the easy steps by which the component parts can be manufactured, in which the inflatable enclosure defining the keel has a longitudinal pinched portion delimiting two communicating chambers located on either side of said pinched portion, this enclosure can be folded along this pinched portion so that the two chambers extend at approximately 90° relative to one another in the inflated state; in such a case stiffening means are provided to join the external walls of these two folded chambers so that they are held more or less perpendicular to one another in the inflated state, one of these chambers forming a base, being joined to the top face of the rubber floor, whilst the other chamber extends substantially perpendicular thereto, forming said keel, which is inflated to a relatively high pressure; advantageously in such a case, a permanent communication is provided between the rubber floor and said chamber forming a base joined thereto.

BRIEF DESCRIPTION OF THE DRAWINGS

The invention will be more readily understood from the detailed description of some embodiments, which are given by way of illustration and are not restrictive in any respect. Throughout this description, reference will be made to the appended drawings in which:

FIG. 10 is a partial view, in perspective and showing a cross section, of a preferred embodiment of a unit combining a pneumatic floor and keel as proposed by the invention;

FIG. 11 is a view of the unit of FIG. 10, seen from underneath; and

FIGS. 12A and 12B illustrate two stages of manufacturing a part of the unit of FIGS. 10 and 11.

DETAILED DESCRIPTION OF THE INVENTION

Figure 1:
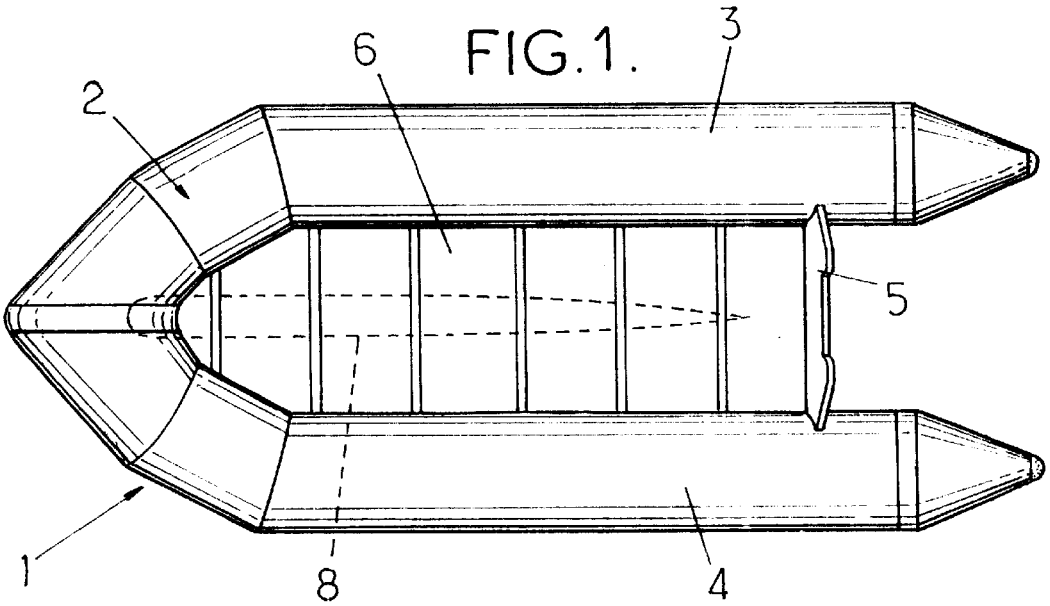
FIGS. 1 and 2 are schematic views respectively from above and from the side, showing a pneumatic boat as a whole, fitted with a keel of the type proposed by the invention.
Figure 2:
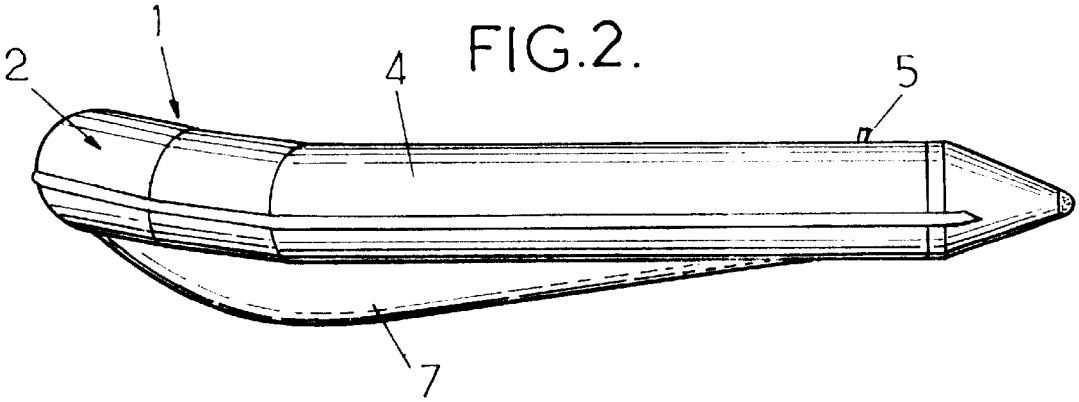
Figure 3:
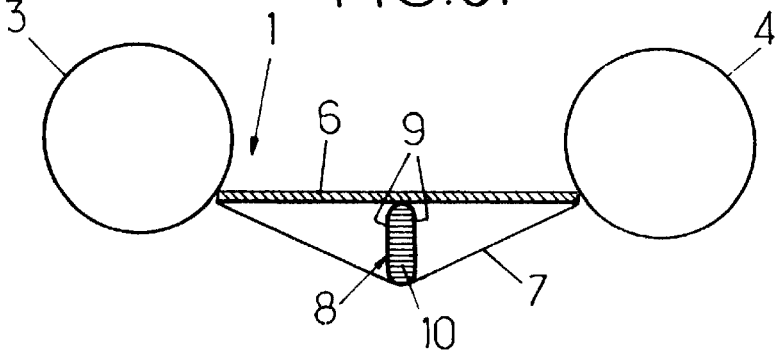
FIG. 3 is a very schematic view in cross section of the boat illustrated in 1 and 2.

Turning firstly to FIGS. 1 to 3, the pneumatic boat, shown as a whole by reference number 1, has a float or buoyancy 2 of a general U shape open towards the rear and consisting of at least one pneumatically inflatable tube, the legs 3 and 4 of which are substantially parallel. Towards their rear end, these legs are braced by a rear board or transom 5.

Inside the space defined by the U-shaped float 2 and the rear board 5 and fixed to them, is a floor 6 which is rigid at least in a transverse direction.

In the example illustrated in 1 to 3, the rigid floor consists of laths or panels extending transversely to the legs of the tube 3, 4, these laths or panels being made from wood or metal, and being hinge-joined with one another in particular.

Finally, a base forming a V-shaped hull is formed by a flexible canvas which is watertightly fixed to the float 2 and the rear board 5 and which is held taut by a pneumatic keel 8, in the form of an elongate inflatable enclosure disposed axially between the rigid floor 6 and the flexible canvas 7.

The general design of this type of pneumatic boat is known from document FR 1 155 376, for example.

Figure 5:
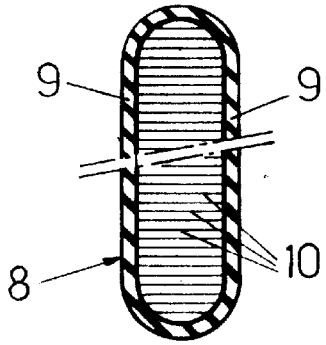
FIG. 5 is a schematic view in cross section of the pneumatic boat illustrated in FIG. 3.

For the purpose of the invention, the pneumatic keel 8 is in the form of an elongate enclosure delimited by two substantially flat and approximately parallel main walls 9 which extend longitudinally in a substantially axial position and are approximately perpendicular to the floor 6. The walls 9 are braced by a plurality of flexible links 10 which, when the enclosure is inflated to a relatively high pressure (to provide a rough idea: in the order of $10^5$ Pa for example, whilst the float 2 is inflated to a substantially lower pressure in the order of 0.2 to $0.3\times10^5$ Pa, for example), hold the main walls 9 in a predetermined relative position, in particular more or less flat and parallel with one another as illustrated in FIGS. 3 and 5. Such an arrangement of a pneumatic keel 8 is illustrated on a larger scale in FIG. 5. The walls 9 may advantageously be provided in a multi-layer design and the links 10 may be provided in the form of a wire anchored in the thickness of the walls 9, in a technique known to those skilled in the art.

As a result of this structure, the pneumatic keel 8 can have any desirable shape, which means that it does not have to be tubular in shape, as in the past, which produced a rounded bow which was not sufficiently streamlined, thereby limiting the navigability of the dinghy.

Figure 4:
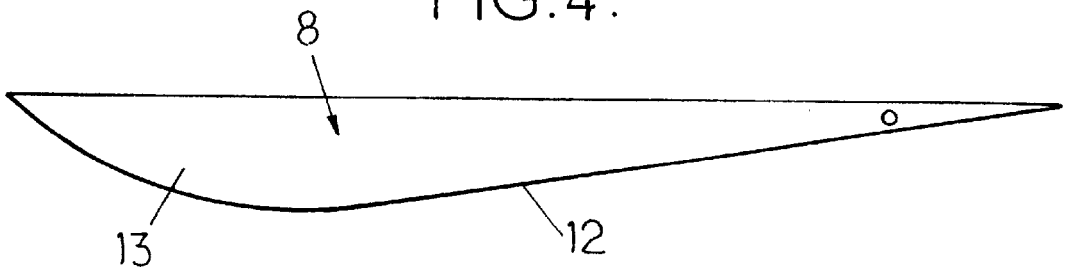
FIG. 4 is a schematic view from the side showing only the pneumatic keel of the boat illustrated in FIGS. 1 to 3.

In the context of the invention, the keel 8 may be of a flat shape with a thickness very much smaller than the height and length, as can be seen particularly clearly from FIGS. 3, 4 and 5. Accordingly, the streamlining of the bow 11 can be much improved (see FIG. 2), this streamlining enabling it to cut through the water better.

Furthermore, the flat-design, inflatable keel may be of any desirable shape. In particular, the bottom edge 12 of the keel may be curved with a maximum height towards the front end 13 (bow) and decreasing progressively towards the rear end.

Accordingly, the keel may have a general shape similar to that of a rigid keel (made from wood for example), with a much greater height at the front end 13 than a conventional inflatable tubular keel would have. This extra height produces a much more pronounced bow, imparting a much more stable heading hold to the dinghy.

Furthermore, because the keel is inflated to a relatively high pressure, it is more rigid, to a degree more akin that that of a conventional rigid keel. This eliminates the disadvantage of the relative longitudinal deformability which conventional inflatable keels exhibit.

The combination of the rigidity, the streamlining and the extra height at the front of the keel as proposed by the invention gives the bow optimum characteristics and specifically improves the performance of the boat.

Figure 6:
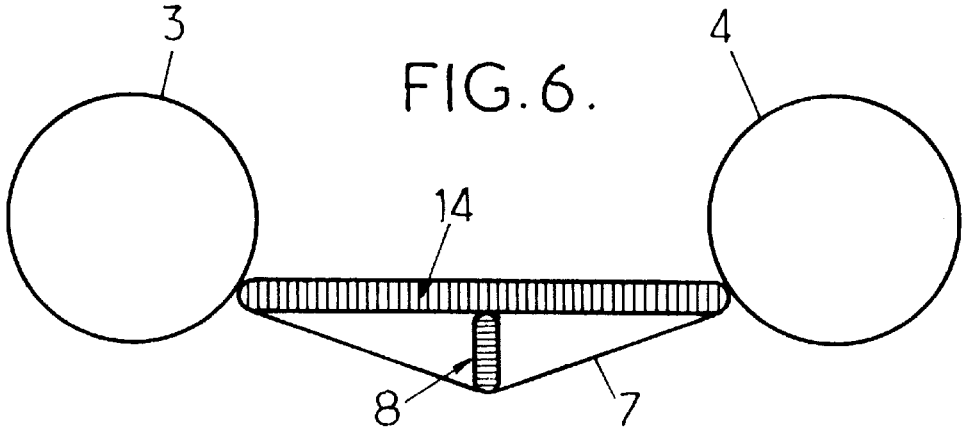
FIG. 6 is a very schematic view, in cross section, of a different embodiment of the pneumatic boat, fitted with a pneumatic floor and a pneumatic keel, as proposed by the invention.

FIG. 6 provides an illustration in a simplified cross section of a boat design in which the floor consists, in a known manner, of a flat pocket 14 delimited by two approximately parallel main walls braced by a plurality of flexible links, this pocket being inflated to a relatively high pressure, using a technique similar to that used to make the keel proposed by the invention. Pneumatic boats fitted with such floors are currently available on the market.

The combination, in a same boat, of a floor and a keel both made in the same way and inflatable to a high pressure produces a very rigid boat and makes it fully deflatable and foldable, without the need for any rigid elements, which are cumbersome to transport and store.

Figure 7:
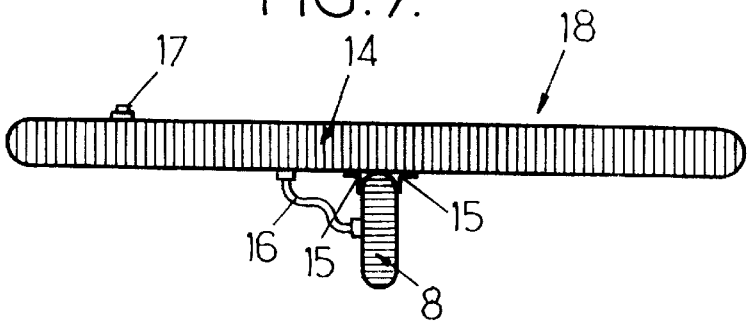
FIG. 7 is a very schematic view, in cross section, showing one example of how the pneumatic floor and keel of the boat illustrated in FIG. 6 might be designed, in the form of a single, T-shaped piece.

As illustrated in FIG. 7, it would then be conceivable to design the inflatable floor 14 and the inflatable keel 8 in the form of a single unit 18 with a T-shaped cross section. To this end, the floor 14 and the keel 8 may be made, using the same technique, in the form of two independent elements which are joined to one another by bonding or welding, for example, fitted with reinforcing and retaining corner-pieces 15. In order to simplify operation of these two pockets of the same design and inflatable to the same pressure, a pneumatic link may be provided between the two (for example a connecting tube 16), in which case only one of them (for example the inflatable floor 14, which is more readily accessible from the interior) will be fitted with a common inflation valve 17.

Figure 8:
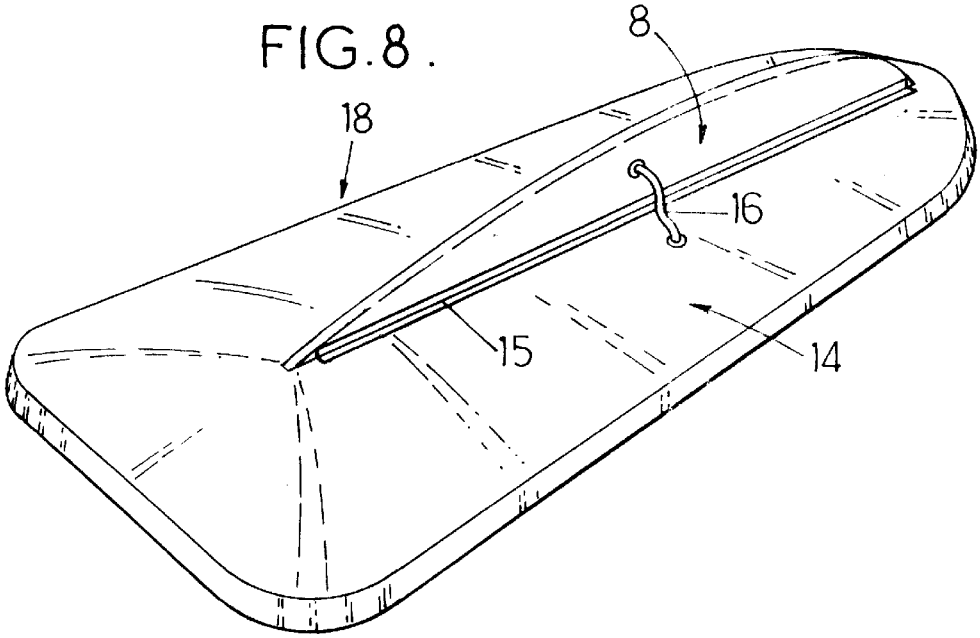
FIG. 8 is a perspective view of the single unit of FIG. 7, shown upturned (keel on top)

FIG. 8 is a perspective illustration of the single piece 18, shown upturned with the keel 8 in the air, in an inflated state.

Figure 9:
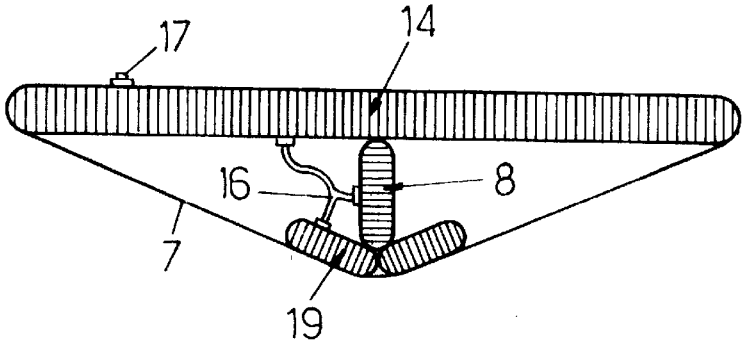
FIG. 9 is a very schematic view, in cross section, of yet another embodiment of a part of a pneumatic boat arranged as proposed by the invention.

FIG. 9 illustrates another possible embodiment in which the hull of the boat is formed, at least in the vicinity of the tip of the V, by at least one flat pocket 19 with a V-shaped cross section: i.e. is formed either by a single pocket with a V-shaped section or is formed by two pockets back to back and mutually inclined to form a V (as in the case illustrated in FIG. 9). Each pocket is then of a flat design with two more or less parallel main walls braced by a plurality of flexible links and is inflated to a relatively high pressure in the same way as the inflatable keel and floor.

The unit formed by the pockets 17, 8 and 19 may again be made in a single unit by reciprocally joining said pockets and providing an inter-connecting pneumatic piece 16.

FIGS. 10 to 12 illustrate an embodiment which is preferred due to the ease with which its components can be manufactured.

Firstly, a flat enclosure 20 (FIG. 12A) is made from the material mentioned above, at the central region of which a pinched portion 21 is provided. The pinched portion 21 extends longitudinally with one or more passages left in it to allow air to flow between the chambers 22 and 23 located on either side during inflation. The longitudinal pinched portion 21 constitutes a fold line allowing the two chambers 22, 23 to be positioned at approximately 90° relative to one another in their inflated state (FIG. 12B). The two chambers are held in this position by means of stiffening elements inserted between them. These stiffening means might be a continuous strip of fabric or several straps 24 (as illustrated in FIGS. 10 and 11) joined (welded, bonded) at the respective extreme edges of the two chambers 22, 23.

The chamber 22 forms a base which is joined (welded, bonded) onto the bottom face of the inflatable floor 14, whilst the chamber 23 extends more or less perpendicular to the inflatable floor 14, to form the inflatable keel 8 mentioned above.

This is a simple way of providing a single structural unit 18 as described above, comprising the inflatable floor 14 and the inflatable keel 8. In order to simplify use of this unit by providing inflation through a single inflation valve 17 arranged in the inflatable floor 14, one or more passages may be provided in the adjoining walls of the chamber 22 forming a base and the inflatable floor 14, respectively (see FIG. 10).

What is claimed is:

1. A pneumatic boat comprising a generally U-shaped float open towards the rear and consisting of at least one pneumatically inflatable tube, the rear ends of which are braced by a rear board, a rigid floor disposed at least transversely inside said float, and a hull with a V-shaped cross section made from a flexible canvas fixed to the float and the rear board and held taut by an inflatable longitudinal keel inserted between said floor and said canvas, wherein the inflatable keel is an elongate enclosure delimited by two flat and approximately parallel main walls extending longitudinally and more or less perpendicular to the floor, these walls being braced by a plurality of flexible links, and wherein this enclosure is inflated to a relatively high pressure.

2. Pneumatic boat as claimed in claim 1, wherein the inflatable enclosure is of a flat, plate-type shape, its thickness being very much smaller than its height and its length.

3. Pneumatic boat as claimed in claim 1, wherein the bottom edge of the inflatable enclosure is curved.

4. Pneumatic boat as claimed in claim 3, wherein the height of the enclosure increases very rapidly from the front end to define a bow, then decreases gradually towards the rear end, and wherein the maximum height of the enclosure in the vicinity of the front end is relatively high causing the tautened canvas to form a streamlined bow of a relatively closed V shape.

5. Pneumatic boat as claimed in claim 1, wherein the floor is an inflatable floor formed by a flat pocket delimited by two approximately parallel main walls braced by a plurality of flexible links, this pocket being inflated to a relatively high pressure, and wherein the inflatable enclosure forming a keel is joined longitudinally and axially to the bottom face of said rubber floor to form a single piece with a T-shaped cross section.

6. Pneumatic boat as claimed in claim 5, a pneumatic communication is established between the inflatable floor and/or the V-shaped pocket of the hull on the one hand and the inflatable enclosure forming a keel on the other, and wherein the single piece is fitted with a single valve for simultaneously inflating the floor and/or the V-shaped pocket of the hull and the keel.

7. Pneumatic boat as claimed in claim 5, the inflatable enclosure defining the keel has a longitudinal pinched portion which defines two communicating chambers located on either side of said pinched portion, wherein this enclosure is folded along this pinched portion so that the two chambers extend approximately at 90° relative to one another in the inflated state, and wherein stiffening means link the external walls of these two folded chambers so as to hold them more or less perpendicular to one another in the inflated state, wherein furthermore one of these chambers forming a base and being joined to the face of the bottom of the rubber floor whilst the other chamber extends substantially axially underneath said floor and substantially perpendicularly thereto forming said keel which is inflatable to a relatively high pressure.

8. Pneumatic boat as claimed in claim 7, wherein a permanent communication is established between the inflatable floor and said chamber forming a base joined thereto.

9. Pneumatic boat as claimed in claim 1, wherein the hull consists, at least in the vicinity of the tip of the V-shape, of at least one flat pocket with a V-shaped cross section inflated to a relatively high pressure and the inflatable enclosure forming a keel is longitudinally and axially joined to the top face of said V-shaped pocket to form a single piece.

* * * * *